US005927718A

United States Patent [19]

Heaton

[11] Patent Number: 5,927,718

[45] Date of Patent: Jul. 27, 1999

[54] GAME APPARATUS

[76] Inventor: George L. Heaton, P.O. Box 455, Camino, Calif. 95709

[21] Appl. No.: 08/947,097

[22] Filed: Oct. 8, 1997

[51] Int. Cl.[6] ..... A63F 3/00

[52] U.S. Cl. ..... 273/272; 273/282.1; 434/208; 434/209; 434/191

[58] Field of Search ..... 273/272, 148 R, 273/282.1, 284, 299; 434/204, 208, 191, 209

[56] References Cited

U.S. PATENT DOCUMENTS 4,059,272 11/1977 Pullman ..... 273/272

FOREIGN PATENT DOCUMENTS 721010 11/1965 Canada ..... 434/209

2658428 8/1991 France ..... 273/272

*Primary Examiner*—Benjamin H. Layno

*Attorney, Agent, or Firm*—Theodore J. Bielen, Jr.

[57] ABSTRACT

A game apparatus utilizing a platform which is divided into a first section, having a first partition to define the same, a second section, having a second partition to define the same, and a third section having a third partition to define the same. The second partition and second section lie intermediate the first and third sections. A first set of game pieces are sized to fit in alignment with one another and in side-by-side configuration within the second section. The first set of game pieces also fit in a side-by-side relationship within the first section. A second set of game pieces of a different configuration than the first set of game pieces are sized to fit singly in the third section.

8 Claims, 2 Drawing Sheets

GAME APPARATUS

BACKGROUND OF THE INVENTION

The present invention relates to a novel and useful game apparatus, particularly effective in honing mathematical skills in children.

Mathematics has been poorly taught and neglected in schools around the world. The result has been a notable decrease in the mathematical skills of persons in all walks of life. The advent of calculators and computers have also lessened the motivation of persons to acquire skills in mathematics. However, the need for mathematical skills has not lessened and is required in many business and personal activities.

A game apparatus which is capable of interesting persons in mathematics and sharpening mathematical skills would be a notable advance in the educational field.

SUMMARY OF THE INVENTION

In accordance with the present invention a novel and useful game apparatus having a mathematical theme is herein provided.

The game apparatus of the present invention utilizes a platform. The platform includes a first section having a first partition to define the same. Likewise, second and third sections are formed by second and third partitions in the same manner. The second partition and the second section lies between the first and third sections. In addition, the second section may extend along a particular dimension, resulting in an open compartment which is elongated.

Fourth and fifth sections may be similarly constructed as open compartments and lie adjacent the second and third sections, respectively. Again, the fourth section may be elongated and lie adjacent the fifth section and, in certain cases, adjacent the first section.

A first set of game pieces is employed and each piece thereof is sized to fit in the second section. Such positioning of the first set of game pieces takes place such that the game pieces are aligned side-by-side and along the confines of the second section. The first set of game pieces are also sized to fit in the fourth section, of the platform in the same manner. The first set of game pieces may include indicia indicating a numeral and, or may include a mathematical operator.

A second set of game pieces is also used in the apparatus of the present invention and are of a different configuration than the first set of game pieces. For example, the first set of game pieces may take the form of square or a rectangular tiles, while the second set of game pieces may be circular or triangular and the like. The different configuration between the first and second game pieces may also be distinguishable on the basis of color or other visual markings. The second set of game pieces are individually sized to fit singly in the third section or the fifth section.

Thus, the first section may be used to store game pieces. Game pieces may be moved from the first section into the second section to create a mathematical relationship between the indicia found on the game pieces. Finally, the third section may be employed to house one of the second set of game pieces indicating a summation or result from the mathematical operations taking place in the second section due to the arrangement of the first set of game pieces therewithin.

It may be apparent that a novel and useful game apparatus has been described.

It is therefore an object of the present invention to provide a game apparatus which is easily useable to teach persons mathematical relationships.

Another object of the present invention is to provide a game apparatus which uses mathematics to entertain persons playing the game.

A further object of the present invention is to provide a game apparatus which may be played by more than one person in competition with each other to determine relative mathematical skills.

A further object of the present invention is to provide a game apparatus which is employed to test mathematical skills of varying degrees and teaches mathematical accuracy.

The invention possesses other objects and advantages especially as concerns particular characteristics and features thereof which will become apparent as the specification continues.

Figure 1:
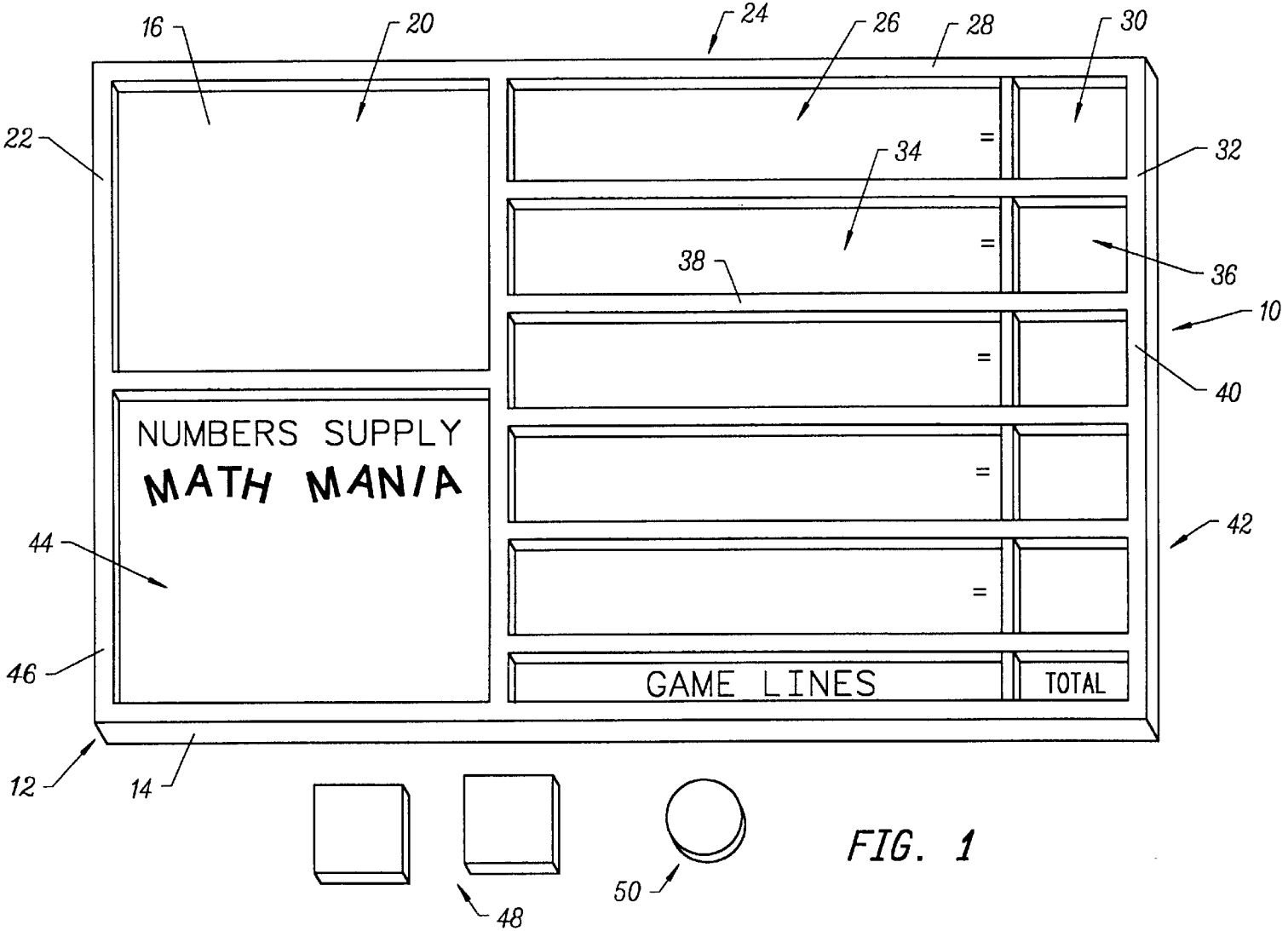
FIG. 1 is a bottom right perspective view of the game apparatus of the present invention depicting game pieces from the first and second sets of game pieces apart from the platform portion of the invention.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be taken in conjunction with the prior described drawings.

The invention as a whole is shown in the drawings by reference character 10. Apparatus 10 includes as one of its elements a platform 12 having a side portion 14 and an upper surface 16. Flat bottom portion 18 of platform 12 allows platform 12 to sit on a planar surface such as a table, desk, workbench, and the like. Platform 12 may be constructed of wood, plastic, metal, or any like material.

Platform 12 is shown with a first section 20. First section 20 is formed by a first rectangular partition 22, defined as a wall which extends from upper surface 16 of platform 12. A plurality of elongated sections 24 are also formed adjacent first section 20. For example, second section 26 is formed by wall partition 28. Adjacent second section 26 is a third section 30 formed by a third wall partition 32. Third section 30 is approximately square in cross-sectional configuration, although this configuration may be varied greatly. Fourth section 34 and fifth section 36 are formed by partitions 38 and 40, respectively. A plurality of square sections similar to sections 30 and 36 are also found on platform 12. Section 44, formed by partition 46, also positions on platform 12 adjacent first section 20. First section 20, plurality of elongated sections 24, plurality of essentially square sections 42, and section 44 are all in the general format of open compartments on platform 12.

Apparatus 10 also includes a first set of flat game pieces 48 which are sized to fit within any of the plurality of elongated sections 24 and in a side-by-side configuration. First set of game pieces 48 are also capable of fitting in side-by-side configuration in first section 20. It may be observed from the drawings, first set of game pieces 48 are rectangular tiles.

A second set of game pieces 50 are also employed in the present invention. Second set of game pieces are constructed in a different configuration from first set of game pieces 48. Such different construction may take the form of a different shape, color, surface characteristic, and the like. In the present embodiment, second set of flat game pieces 50 have been formed into discs to contrast the rectangular solid configuration of first set of game pieces 48.

Figure 2:
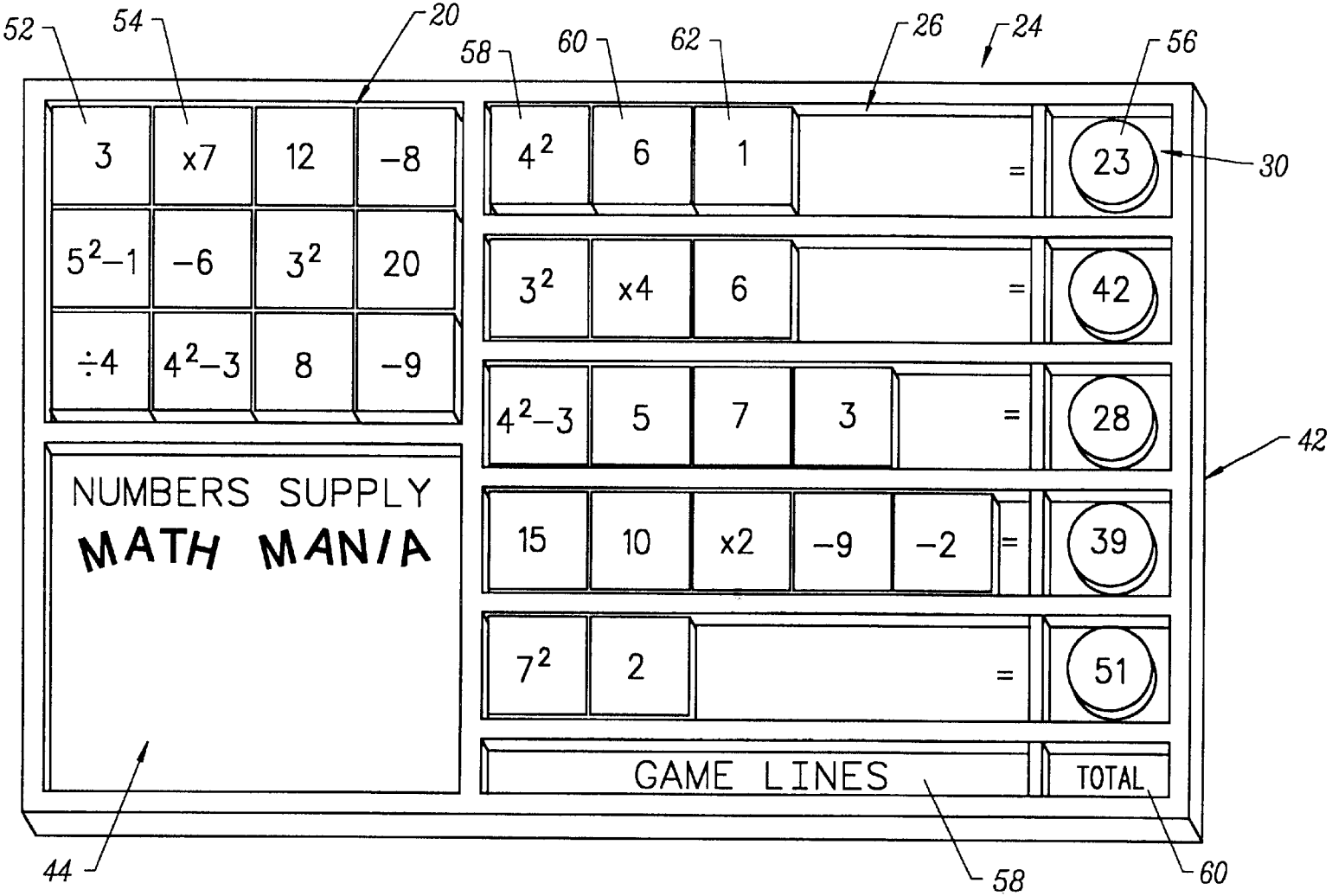
FIG. 2 is a bottom right perspective view of the game apparatus of the present invention with the first and second sets of game pieces found within the various sections of the platform portion of the invention.

Turning to FIG. 2, it may be observed that first set of game pieces 43 may be marked with numeric and/or mathematical operator indicia. For example, game piece 52 has been marked with the number "3". Game piece 54 has been marked with the numeral "7" and the mathematical operator "x" to indicate multiplication. Game piece 56 of second set of game pieces 50 is simply marked with the number "23".

In operation, the user may store first set of game pieces 48 in section 44 in any manner, upside down, right-side up, chaotically piled, and the like. In general, a game may be played by placing a number of the second set of game pieces 50 within section 44. Any one of the game pieces of the second set of games pieces 50 may then be placed in one or more of the plurality of essentially square sections 42 on the extreme right hand side of platform 12. For example, the game piece 56 has been placed in third section 30 in this regard. A certain number of game pieces of the second set of game pieces 50 may be kept within section 44 from a cache, not shown. The player may then fill first section 20 with a number of game pieces from the first set of game pieces 48, a total of 12 such game pieces is depicted in FIG. 2. Selecting the appropriate number and/or number and mathematical operator from the first set of game pieces 48 in first section 20, to achieve the total of the particular game pieces of the second set of game pieces 50 placed in any one of the plurality of sections 42, is the object of the game played with apparatus 10. For example, second section 26 includes game pieces 58, 60, and 62. Game piece 58 indicates the number "$4^2$", totaling 16. Adding "16" to the numeral "6" of game piece 60 and "1" of game piece 62 totals "23", which is the indicia found on game piece 56 in third section 30. Thus, the second game piece 56 corresponds to the first set of game pieces 58, 60, and 62 in second section 26. This process holds true for the remaining plurality of elongated sections 24 and plurality of relatively square sections 42. The game associated with apparatus 10 may be played competitively between players having similar platforms, such as platform 12. The winner of such a contest may depend on time and accuracy in matching the particular game pieces of the second set of game pieces 50 placed in any one of the sections 42, and the first set of game pieces 48 placed in any one of the plurality of elongated sections 24. Areas 58 and 60 include indicia which help the players visualize the placement of first and second game pieces 48 and 50.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A game apparatus, comprising:

a. a platform, said platform including a first section including a first partition defining said first section, a second section adjacent said first section, said second section including a second partition defining said second, and a third section adjacent said second section, said third section including a third partition defining said third section;

b. a first set of flat game pieces. said second partition sized to receive a plurality of flat game pieces of said first set when laid flat in said second partition, said second partition sized to position said flat game pieces only in an aligned side-by-side relationship, and said first partition sized to receive a plurality of flat game pieces of said first set when laid flat in said first partition forming a plurality of rows and columns of game pieces in side-by-side relationship and in aligned up and down relationship;

c. a second set of flat game pieces of a different configuration than said first set of flat game pieces, said third partition sized to receive only one flat game piece of said second set when laid flat in said third partition section; and d. a storage section formed by a partition on said platform, said storage section holding at least game pieces from said first set of game pieces in random order.

2. The game apparatus of claim 1 in which said first and second sets of game pieces include numeric indicia.

3. The game apparatus of claim 2 in which said first set of game pieces further include a mathematical operator.

4. The game apparatus of claim 1 which additionally comprises a fourth section and a fourth partition defining said fourth section, said fourth section lying adjacent said second section, said first set of game pieces sized to fit within said fourth section in an aligned side-by-side configuration.

5. The game apparatus of claim 4 which additionally comprises a fifth section and a fifth partition defining said fifth section, said fifth section lying adjacent said third section, each of said second game pieces of said second set of game pieces sized to fit singly in said fifth section.

6. The game apparatus of claim 5 in which said first section, third, fourth, and fifth sections comprises open compartments.

7. The game apparatus of claim 6 in which said first and second sets of game pieces include numeric indicia.

8. The game apparatus of claim 7 in which said first set of game pieces further include a mathematical operator.

* * * * *